US006394857B1

(12) United States Patent
Crochet

(10) Patent No.: US 6,394,857 B1
(45) Date of Patent: May 28, 2002

(54) ELECTRICAL BOX

(76) Inventor: Marty Crochet, 175 E. 110th St., Galliano, LA (US) 70354

( * ) Notice: Subject to any disclaimer, the term of this patent is extended or adjusted under 35 U.S.C. 154(b) by 0 days.

(21) Appl. No.: 09/616,495

(22) Filed: Jul. 14, 2000

(51) Int. Cl.[7] ..... H01R 9/22

(52) U.S. Cl. ..... 439/721; 439/709; 439/463; 439/416; 174/59

(58) Field of Search ..... 439/709, 721, 439/463, 595, 416; 174/59; 24/134 R

(56) References Cited

U.S. PATENT DOCUMENTS

| | | | | | |
|---|---|---|---|---|---|
| 350,829 | A | * | 10/1886 | Jones | 439/416 |
| 502,083 | A | * | 7/1893 | McEvoy | 174/59 |
| 637,457 | A | * | 11/1899 | Greenfield | 174/59 |
| 3,845,457 | A | * | 10/1974 | Reimer | 439/463 |
| 3,848,224 | A | * | 11/1974 | Olivero | 439/721 |
| 3,913,773 | A | | 10/1975 | Copp et al. | |
| 4,607,902 | A | * | 8/1986 | McKenzie | 439/595 |
| 5,380,951 | A | | 1/1995 | Comerci et al. | 174/48 |
| 5,415,564 | A | | 5/1995 | Winter | 439/535 |
| 5,525,754 | A | | 6/1996 | Akins | 174/53 |
| 5,591,938 | A | | 1/1997 | Navazo | 174/50 |
| 5,628,418 | A | | 5/1997 | Deschamps et al. | |
| 5,897,399 | A | * | 4/1999 | Emery | 439/709 |
| 5,950,853 | A | | 9/1999 | Jorgensen | |

* cited by examiner

*Primary Examiner*—Gary Paumen
*Assistant Examiner*—Felix D. Figueroa
(74) *Attorney, Agent, or Firm*—Kenneth L Tolar

(57) ABSTRACT

An electrical box includes a hollow housing having a plurality of radially extending arms each terminating at an end. Received within the housing and positioned adjacent an end of each arm are one or more sets of electrical busses to which cable wires are attached. Each set of busses includes vertically staggered bus bars each having a piercing screw received therein for penetrating wire insulation thereby eliminating the need to strip the wires prior to installation. A cable locking device is mounted on the side of each arm for locking a cable to the housing, preventing the wires from being inadvertently detached from the bus bars. The device is designed to allow a user to quickly and conveniently connect various electrical components such as light fixtures, switches and wall receptacles to a main power source.

9 Claims, 6 Drawing Sheets

ELECTRICAL BOX

BACKGROUND OF THE INVENTION

The present invention relates to an electrical box that allows a user to quickly and conveniently connect various electrical components to a main power source.

DESCRIPTION OF THE PRIOR ART

Conventional electrical boxes are used to connect various electrical components within a room, such as wall receptacles, lights and switches, to a main power cable. However, using conventional electrical boxes to connect such components is tedious and difficult. Typically, a portion of the main power cable insulation is removed to expose three internal wires (i.e. hot, neutral and ground). A portion of the insulation is likewise removed from each electrical component power cable. Each of the wires are stripped, inserted into the electrical box and intertwined. The intertwined, stripped portion of the wires are then covered with electrical tape or twist connectors.

In addition, later installing an additional electrical component such as a secondary light or ceiling fan is particularly difficult in that the tape or twist connectors must be removed to expose the intertwined wires so that the additional electrical component wiring can be coupled therewith. The problem is further exacerbated whenever the electrical box is attached to a wall stud requiring the wall to be cut and later repaired. The present invention provides a uniquely designed electrical box particularly designed to be attached to a ceiling joist in an attic or a floor joist in a basement or crawl space that allows a user to easily interconnect a plurality of electrical components with a main power cable.

Various electrical boxes exist in the prior art. For example, U.S. Pat. No. 5,525,754 issued to Akins discloses a wall mounted junction box for connecting an electrical cable with an electrical fixture. The device includes a housing having a plurality of cable ports thereon. Within the housing are spaced busses each having contact elements to which cable wires are attached. The busses provide electrical connection between various electrical fixtures and a power cable.

U.S. Pat. No. 5,415,564 issued to Winter discloses a wall mounted electrical junction box having preset electrical terminals mounted at predetermined locations in the box. Electrical line attachments are provided on the periphery of the box. The box is configured so that various electrical components can be attached thereto while establishing electrical contact with the terminals.

U.S. Pat. No. 3,913,773 issued to Copp et al. discloses a ceiling box for electrical outlets including a housing having a hanger bracket integrally formed on the upper side thereof The hanger bracket receives an extendable metal rod that is fastened between a pair of spaced parallel ceiling joists.

U.S. Pat. No. 5,380,951 issued to Comerci et al. discloses an outlet assembly for interconnecting electrical components to flat cable wires behind a wall. A mounting bracket is secured to a wall stud and includes a peripheral frame surrounding a frame opening. A cable tap sub-assembly is attached to the cable. A mounting box is attachable to the peripheral frame and is inserted through an opening in the wall and the mounting opening in the bracket.

U.S. Pat. No. 5,950,853 issued to Jorgensen discloses a universal ceiling box adapted to interchangeably support a ceiling fan or a light fixture. The box includes a top portion with a side portion extending perpendicularly from the perimeter thereof. A mounting element extends from the side portion to which either ceiling fans or a light fixture are secured. The mounting element includes a first pair of mounting holes having a predetermined diameter for receiving ceiling fan screws and a second pair of mounting holes with a smaller diameter for receiving light fixture screws.

U.S. Pat. No. 5,628,418 issued to Deschamps et al. discloses an electrical fixture mounting device for hanging a fan or light from a ceiling. The device includes a box having a closed top, an open bottom and a continuous side wall with slots thereon. A wire is fastened at one end to the box and at the other end to an overhead support structure to suspend the box therefrom.

U.S. Pat. No. 5,591,938 issued to Navazo discloses a box-shaped support member for receiving an electrical conductor tray.

As indicated above, electrical boxes for interconnecting appliance power cables with a main power cable exist. However, they have several disadvantages. Each box requires that the wires be stripped before attaching them to a respective terminal or bus. Furthermore, none of the devices are configured to allow quick and easy connection between a power cable and a plurality of electrical components, especially when a component is later added after initial installation of the original components. Finally, most of the conventional electrical boxes are designed to be mounted within a wall. The present invention provides an electrical box particularly designed to be installed in an attic or crawl space thereby providing easy access thereto. In addition, the box according to the present invention includes radially extending arms each having a set of busses therein that allow a user to easily determine which set of busses are predesignated for a particular type of electrical component. Finally, the present invention provides a unique cable locking means to prevent a cable from being inadvertently detached from the box.

SUMMARY OF THE INVENTION

The present invention relates to an electrical box for connecting various electrical components to a main power cable. The box includes a substantially hollow housing that is preferably either T-shaped or cross-shaped. The housing includes a plurality of radially extending arms, each terminating at an end. Received within the housing and positioned adjacent the end of each arm is one or more sets of busses to which electrical cable wires are attached. A power input cable is connected to one set of busses. Each set of busses includes three, vertically staggered bus bars, each having a piercing screw received therein that not only fastens each wire to the bus but also establishes electrical connection therebetween thereby eliminating the need to strip the wires prior to installation. A locking device clamps each cable to the housing thereby preventing the wires from being inadvertently detached from the busses.

It is therefore an object of the present invention to provide an electrical box that allows a user to quickly and conveniently connect any one of a plurality of electrical components to a main power cable. It is another object of the present invention to provide an electrical box in which various cable wires can be electrically connected without stripping the wires contained therein. It is yet another object of the present invention to provide an electrical box that allows a user to easily align a wire with a designated electrical bus. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
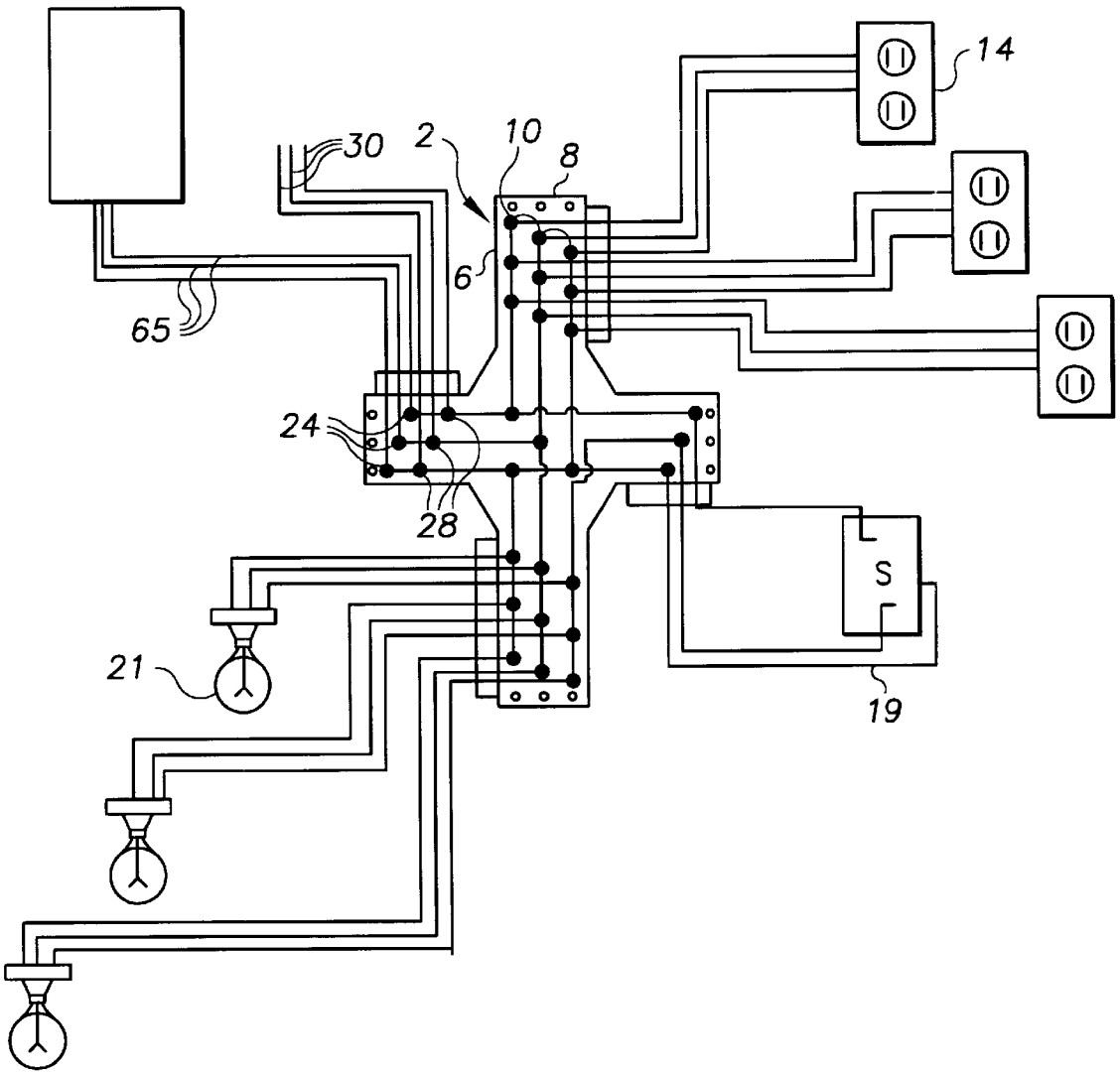
FIG. 1 depicts an exemplary electrical box with several electrical components connected thereto.
Figure 2:
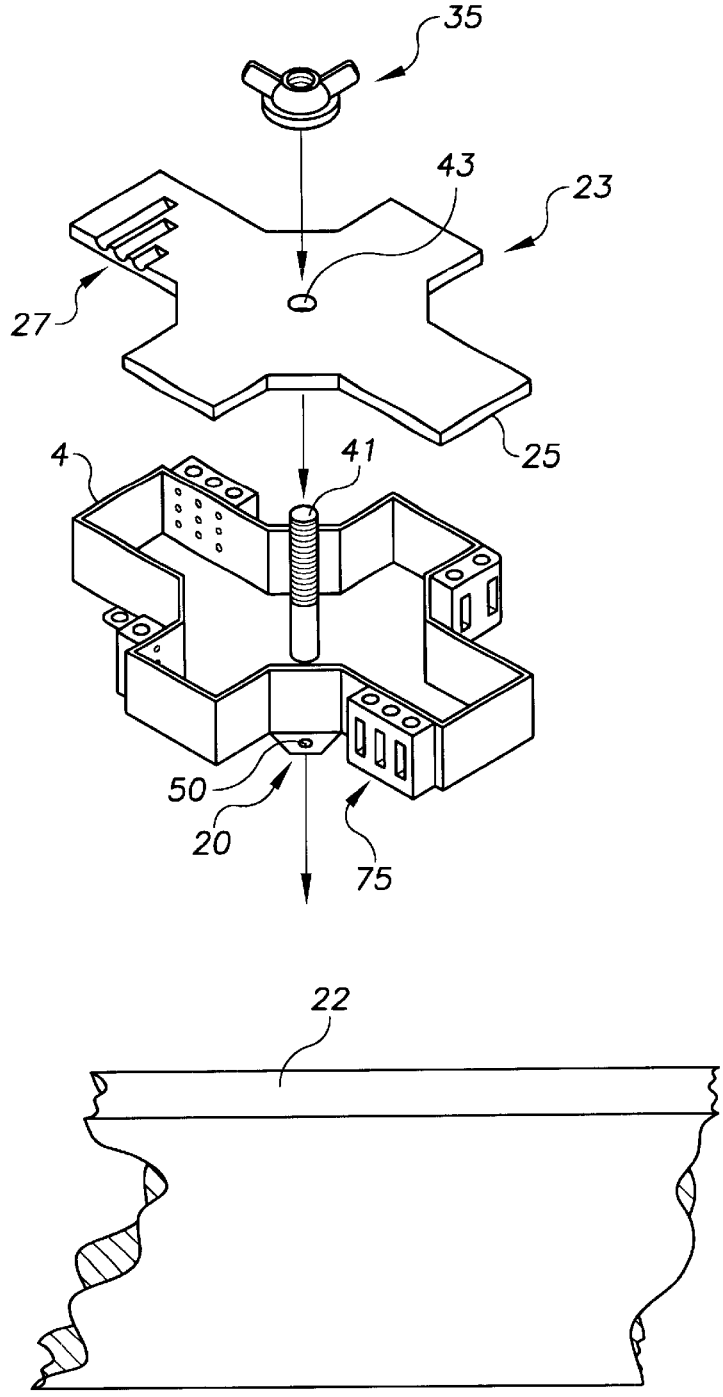
FIG. 2 is an exploded perspective view of a typical embodiment of the electrical box.
Figure 3:
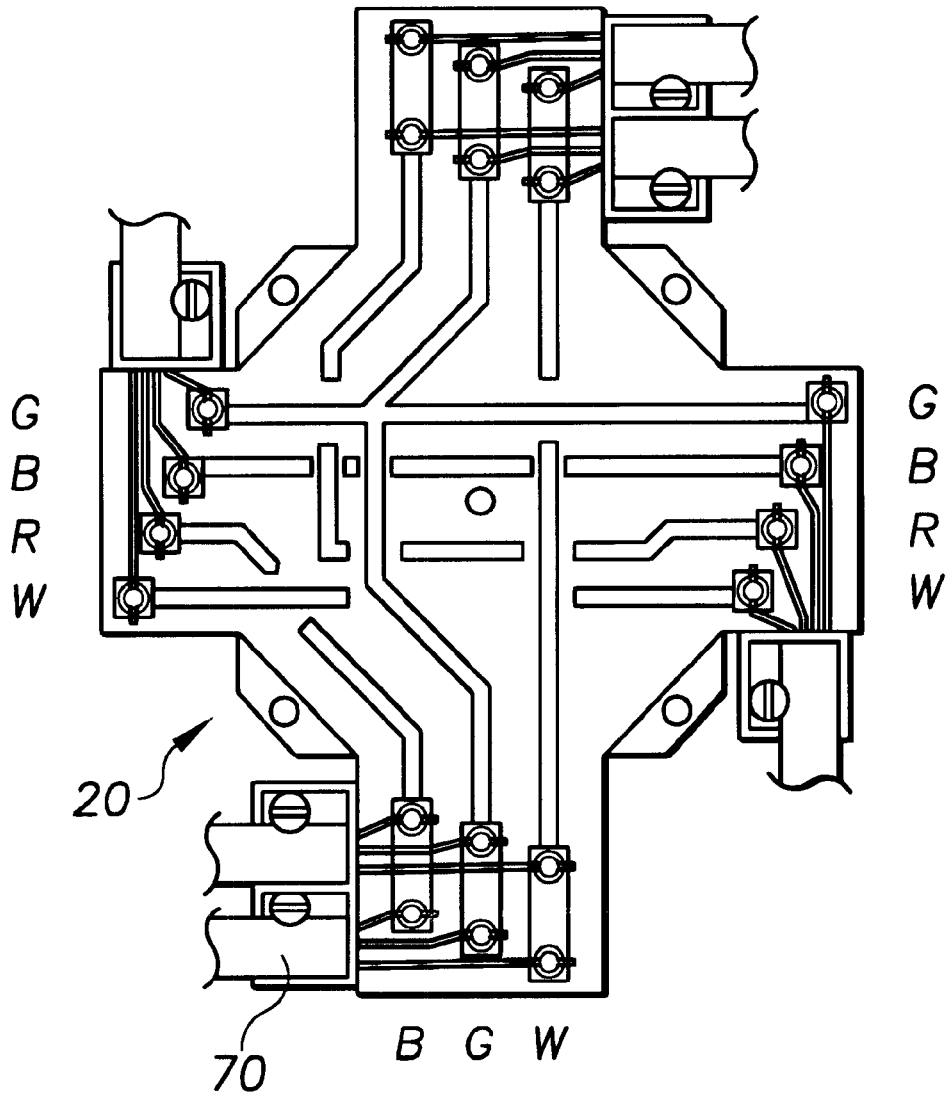
FIG. 3 is a top view of the electrical box with the cover removed therefrom, the box being particularly designed for a 3 way switch.

Referring generally now to FIGS. 1–8, the present invention relates to an electrical box 2 for connecting power cables from various electrical components to a main power cable. The box includes a hollow housing 4 having a plurality of radially extending arms 6, each arm terminating at an end 8. Preferably, the housing is T-shaped or cross-shaped although the shape, configuration and number of arms can be varied. One or more flanges 20 are positioned between adjacent arms, each having an aperture 50 thereon. A screw or similar fastener is inserted into the aperture to secure the housing to a ceiling joist 22 or any other suitable location. Received within the housing and positioned adjacent the end of each arm is one or more sets of busses 10. At least one set of busses represents a power input terminal 24 and is connected to the wires 65 within an incoming power cable 26. An adjacent set of busses 28 can be connected to the wires 65 within an outgoing power cable 30 which in turn can be connected to a downstream electrical box or electrical component. Each of the busses within the other arms are connected to cables 70 from various electrical components such as wall receptacles 14, switches 19 and lights 21. The unique configuration of the box conveniently segregates each set of busses to allow a user to easily determine which set is predesignated for a particular type of component. For example, as depicted in FIG. 1, a plurality of electrical receptacles 14 could be connected to the busses positioned within a first arm while a plurality of lights 21 could be connected to the busses positioned within a second arm.

Figure 7:
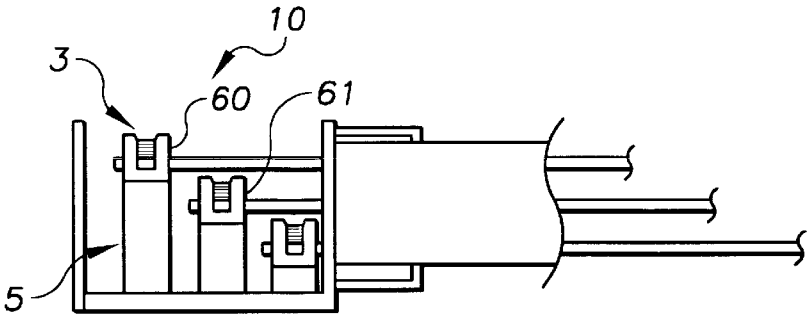
FIG. 7 is a side, cross-sectional view of a set of electrical busses.
Figure 8:
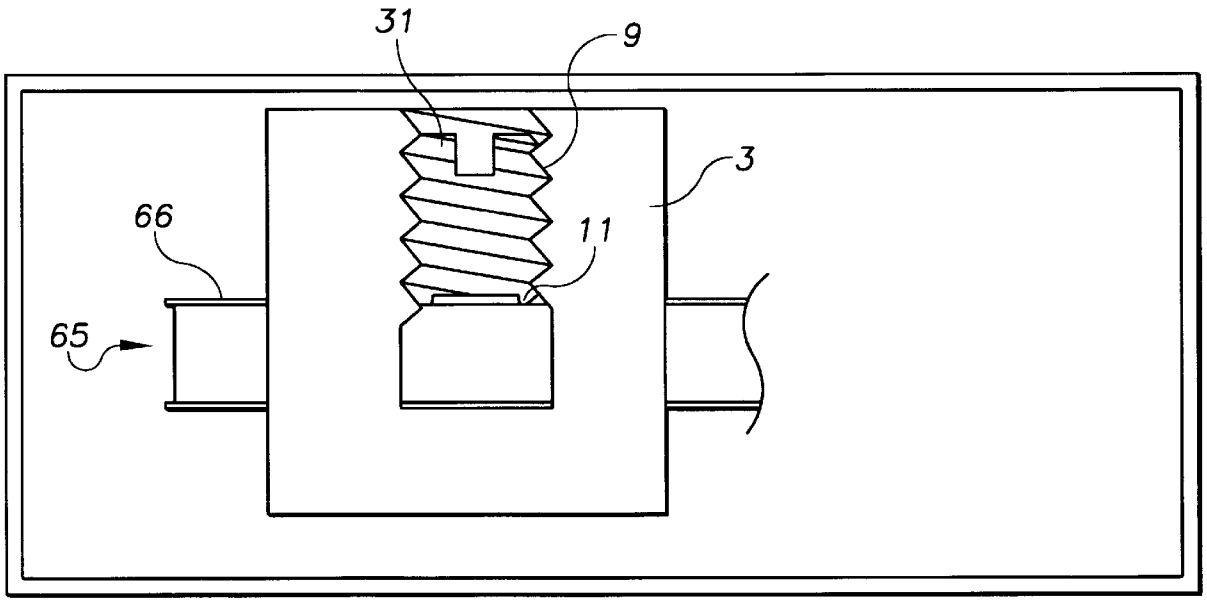
FIG. 8 is a side, cross-sectional view of a bus bar and piercing screw.

Now specifically referring to FIGS. 7 and 8, each set of busses 10 includes three hollow conductive bus bars 3 (ground, neutral and hot) each mounted on a non-conductive shaft 5 that is integrally molded with the electrical box. Each bus bar is electrically connected to each of the other similar bus bars within the other arms (i.e. each neutral bus bar is electrically connected to the other neutral bus bars, etc.) Each bus bar includes a continuous outer wall 60 having a pair of opposing apertures 61 thereon for receiving a select wire from a power cable. Each of the three bus bars within a set are positioned at a different height relative to the other two bus bars. Three vertically aligned ports are positioned on a side of the arm, each positioned at substantially the same height as and aligned with a designated bus bar providing selective access thereto. Each bus bar further includes an internally threaded bore 9 that receives a screw 31. The screw includes a tang 11 on the lower end that pierces the wire insulation 66 when the screw is tightened thereagainst. Accordingly, electrical and physical connection between the insulated wire and bus bar is easily established by tightening the screw.

Figure 4:
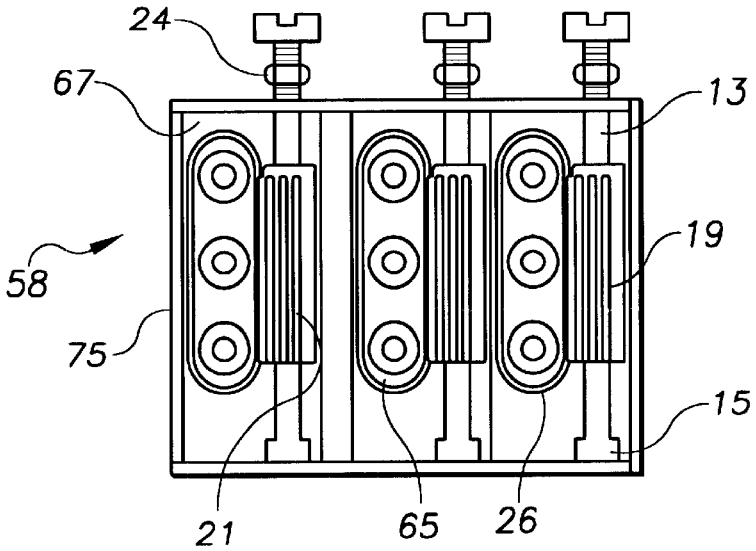
FIG. 4 is a side, cross-sectional view of a plurality of cable locks.
Figure 5:
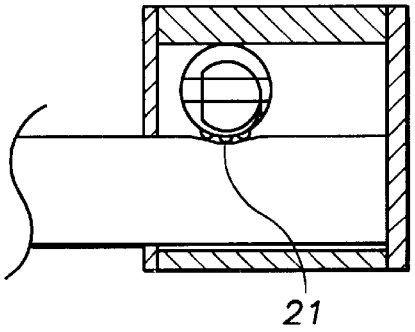
FIG. 5 is a top cross-sectional view of a cable lock in the locked position.
Figure 6:
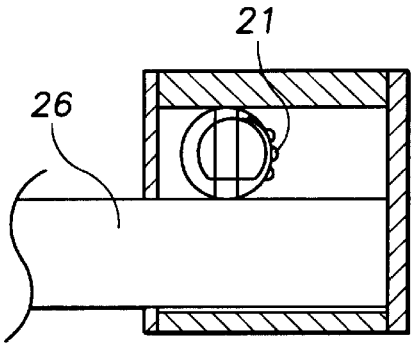
FIG. 6 is a top cross-sectional view of a cable lock in an unlocked position.

Now referring to FIGS. 4–6, a cable locking device 58 is superimposed on each group of ports for securing each cable to the electrical box. Each wire locking device includes a hollow base component 75 having one or more compartments 67 therein. The base component includes an opening in communication with each compartment for receiving a cable. An elongated pin 13 is vertically received within the compartment and threadedly engages a threaded cylinder 15 at the lower portion of the compartment. A central portion of each pin includes a semi-cylindrical boss 19 having a plurality of longitudinal teeth 21 thereon. When the pin is rotated to a first, locked position, the teeth tightly engage the cable; when the pin is rotated to a second, unlocked position, the boss rotates and disengages the cable. The pin may be secured in either of the two positions using a threaded lock nut 24.

The box also includes a cover 23 that is configured similarly as the housing. The cover includes a peripherally depending lip 25 that retains the cover on the upper portion of the housing. A threaded post 41 extends vertically from a central portion of the housing and is received within a centrally disposed aperture 43 on the cover when the cover is mounted to the housing. A wing nut 35 or similar fastener is secured to the post to tightly secure the cover to the housing. On the upper surface of the cover is a gauge 27 comprising three indentions, each representing a length to which each wire must be cut in order to properly fit within a designated bus bar.

Figure 10:
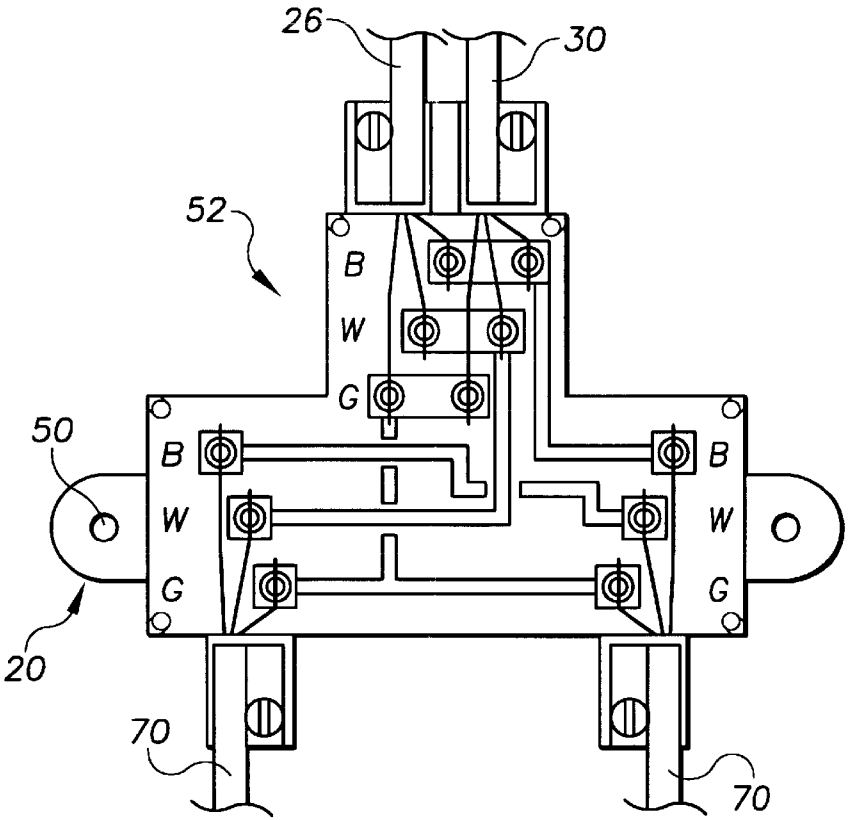
FIG. 10 depicts an alternate embodiment of the splicer box particularly designed to receive power from another splicer box or any of the electrical boxes depicted in FIGS. 1–3.
Figure 9:
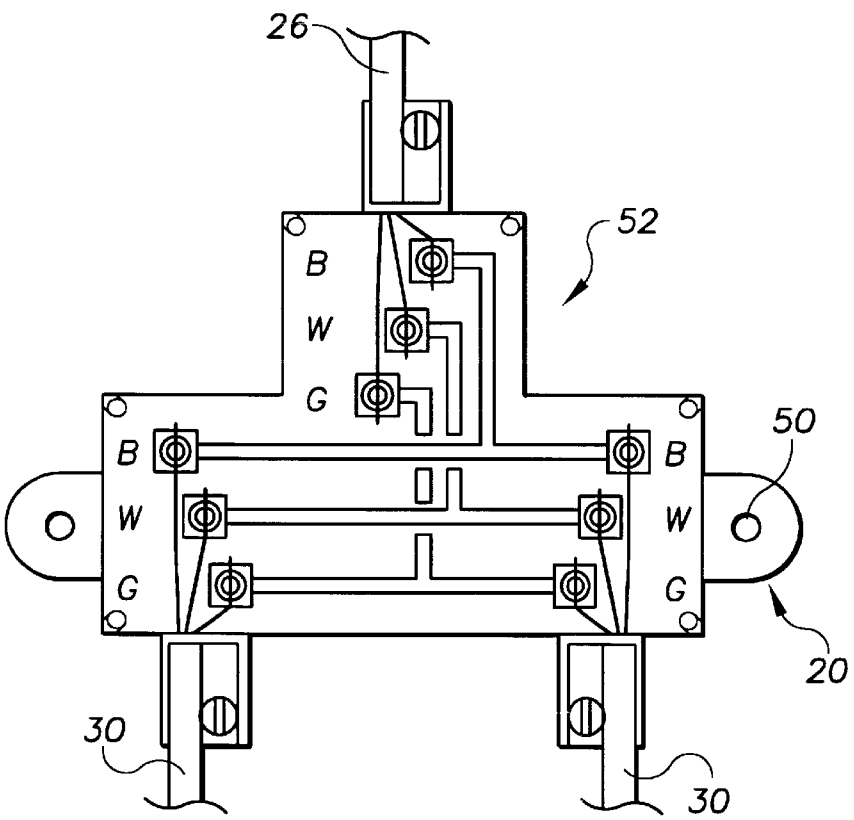
FIG. 9 depicts a top view of an inline splicer box.

Now referring to FIGS. 9 and 10, a splicer box 52 is disclosed for splitting a single power cable into two separate power cables or for interlinking multiple electrical boxes, splicer boxes or a combination of both. Each splicer box is shaped and configured similarly as the electrical box and includes at least one power outlet terminal for routing an outgoing power cable to another electrical or splicer box.

To use the above described device, a portion of the insulation on an incoming power cable is removed to expose the three wires contained therein. Each of the three wires are cut to the appropriate length using the gauge on the cover. Each wire is then inserted into each power input bus bar via the ports and the screw is tightened thereagainst. The incoming power cables from any one of a plurality of electrical components are similarly fastened to the remaining electrical busses. Each cable is then locked to the housing by rotating the pin to the locked position and tightening the lock nut thereby preventing the wires from being inadvertently detached from the bus bars.

The housing according to the present invention is preferably constructed with plastic or any other suitable material. However, as will be readily apparent to those skilled in the art, the size, shape and materials of construction can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An electrical box comprising:

a hollow housing having a plurality of sets of electrically interconnected busses disposed therein, at least one set of said busses representing an input power terminal, said housing further including a plurality of ports thereon; each of said electrical busses including a plurality of bus bars, each bus bar including a hollow interior with a set screw received therein, said screw including a tang on a lower portion thereof for piercing wire insulation to electrically and physically connect a wire to said bus bar;

a cable locking means for securely locking a cable to said housing to prevent wires within said cable from inadvertently detaching from said busses; said locking means including a hollow base component having an opening thereon in communication with an interior compartment, said base component superimposed on said ports; an elongated pin received within said base component, said pin including a boss thereon, said boss tightly engaging a cable when said pin is rotated to a first position, said boss disengaging said cable when said pin is rotated to a second position; said pin being received within and threadedly engaging a threaded cylinder on a portion of said compartment; said pin protruding from said base component and having a locking nut mounted thereon for securing said pin in either of said two positions.

2. The electrical box according to claim 1 wherein each of said bus bars are positioned at a different height relative to each of the other bus bars.

3. The electrical box according to claim 2 wherein said ports are vertically aligned on said housing, each port positioned at substantially a same height as and aligned with a designated bus bar providing selective access thereto.

4. The electrical box according to claim 1 wherein said housing further includes an open top and a cover removably attachable to the housing to cover said open top.

5. The electrical box according to claim 4 wherein said cover includes a peripherally depending lip to retain said cover on the upper portion of the housing.

6. The electrical box according to claim 4 further comprising:

a threaded post vertically extending through a central portion of the housing;

said cover including a centrally disposed aperture for receiving said threaded post;

a fastener means mounted on said post for tightly securing the cover to the housing.

7. The electrical box according to claim 4 wherein said cover includes a wire gauge thereon to assist a user in cutting each wire to a proper length so as to properly fit within a designated bus bar.

8. The device according to claim 7 wherein said wire gauge includes a plurality of indentions, each indention representing a discrete length to which a wire must be cut in order to fit within a designated bus bar.

9. The device according to claim 1 wherein said housing includes a plurality of radially extending arms, each arm terminating at an end, each arm having at least one set of electrical busses received therein, each set of busses positioned adjacent the end of said arm.

* * * * *